United States Patent [19]

Latimer

[11] 4,365,787

[45] Dec. 28, 1982

[54] PIPE STRING LIFT SYSTEM

[75] Inventor: John P. Latimer, Newport News, Va.

[73] Assignee: Deepsea Ventures, Inc., Gloucester Point, Va.

[21] Appl. No.: 108,122

[22] Filed: Dec. 28, 1979

[51] Int. Cl.[3] ..... B66F 1/00

[52] U.S. Cl. ..... 254/106

[58] Field of Search ..... 405/202; 254/105–111, 254/95–97

[56] References Cited

U.S. PATENT DOCUMENTS

| | | | |
|---|---|---|---|
| 3,517,910 | 6/1970 | Sutton et al. | 254/106 X |
| 3,565,400 | 2/1971 | Yamura | 254/106 |
| 3,765,649 | 10/1973 | Raaymakers | 254/106 |
| 4,109,975 | 8/1978 | Mattson | 254/108 X |

FOREIGN PATENT DOCUMENTS

| | | | |
|---|---|---|---|
| 934369 | 8/1963 | United Kingdom | 254/105 |

*Primary Examiner*—Robert C. Watson

*Attorney, Agent, or Firm*—Barry G. Magidoff

[57] ABSTRACT

This invention provides a system for supporting a long, heavy dredge pipe string from a moving surface vessel, with a minimum of stress being applied to the pipe. The system comprises a gimbaled platform, supported over a central well through a vessel by two horizontal axes perpendicular to each other. A carriage is supported from the platform on hydraulic piston rods. Pipe string support plates are movably secured to facing surfaces on the carriage and platform, arranged about central openings, to permit close-coupling of the two sets of support plates when transferring the pipe string. There is also provided a pair of lateral support members for the pipe string at the bottom of the well.

7 Claims, 20 Drawing Figures

11
32
33
36
37
90
12
35
43
38
39
40
139
138
15
A
B

A
B
C
11
12
32
33
35
36
38
39
40
43
138
139

PIPE STRING LIFT SYSTEM

This invention is directed to means for supporting a relatively heavy, long, downwardly extending pipe string from a moving surface vessel, during dredging operations and during the paying out, or bringing in, of the pipe, so as to limit stress on the pipe and on the vessel. This invention is especially adapted for use in the support of the extremely lengthy and heavy dredge pipeline used in the recovery of ore material from the abyssal ocean floor.

With the recognition that terrestrial sources for raw materials, especially ores, are being swiftly depleted, effort has been made to obtain these valuable industrial raw materials from other sources, one being especially the abyssal depths of the oceans. Such raw materials, especially metal ores, are often found at depths of between 10,000 and 18,000 feet below the surface, requiring extremely deep water dredging means. The most valuable ores found to date are known as ocean floor nodule ores, or manganese nodules. These nodules are often found as relatively small particulate forms, including fist-sized rocks or smaller pebbles, or even as grains of sand. Sometimes solid shelves of these materials are found which would have to be broken up in order to be obtained.

A great deal of engineering effort has been undertaken to date to develop mechanical means to mine such ores and to bring the ores to the surface for further processing. One system now under development for carrying ocean floor ores to the surface of the ocean comprises a dredging vehicle, operating at or near the ocean floor, and a water-lift system, wherein the ore particles are carried upwardly to the surface in a stream of water defined by a length of pipe extending from the undersea dredge vehicle to a surface vessel. This pipe system is generally part of a so-called airlift means, wherein the water within the pipe is caused to flow upwardly by means of injections of air into the pipe at points below the surface.

A serious practical problem encountered in the design and operation of such a mining system arises as a result of the great weight of the dredge pipe string, which is of high strength, relatively thick, steel piping, extending for distances of, generally, from about two to three-and-one-half miles. The string is generally formed from a series of relatively short lengths of pipe, several hundred individual lengths, or sections, making up the total dredge pipe string. Necessary support for the dredge pipe string must be accomplished not only during the time when the entire pipe string is in place and dredging occurs by moving a dredge vehicle along the ocean surface, but also during so-called "tripping", when the pipe string is being let down to the ocean floor, i.e., by adding individual sections one at a time and gradually permitting the pipe string to thus descend towards the ocean floor, or when the pipe is being brought in, i.e., individual sections of pipe are serially removed from the pipe string and stored, while the dredge pipe length is gradually being shortened and the dredge vehicle brought to the surface of the ocean.

Support for the pipe string must be secure. An ocean mining pipe string can weigh as much as about 10,000 tons, and is extremely valuable. The support means must also be so designed as to limit the strain imposed upon the pipe, especially at the point of support on the pipe string.

It is known to support an ocean mining pipe string by two or more units, vertically spaced in a central well formed through a surface vessel, and arranged to engage spaced collars on the pipe. During the tripping operation, the support units alternately engage spaced collars on the pipe, in moving the pipe upwardly or downwardly. There is also provided a third support means to "park" the pipe in a static, hold, condition. See, for example, U.S. Pat. No. 3,939,991, to Person, and the copending application Ser. No. 479,094, of June 13, 1974, referred to therein.

As ocean mining usually involves a dredging operation where the surface vessel, and therefore the pipe string, move through the water, the pipe string normally does not extend directly downwardly, but usually curves rearwardly and downwardly. This translational movement, it was believed, compensated for most of the strain on the pipe string, created by rolling and pitching of a surface vessel and which is met with, for example, in an oil well riser pipe, which is anchored to the ocean floor, as in U.S. Pat. No. 3,496,898, to Morgan, extending to a stationary surface vessel.

In accordance with the present invention, there is provided a system for lifting and supporting a segmented string of downwardly extending pipe from a surface vessel. In the lift system of the present invention, there is provided, on a floating surface vessel, a platform, having a central opening therethrough, and pivotally connected to the surface vessel about two axes of rotation; pipe string support means secured to the platform and arranged so as to support a segmented string of pipe, passing through the central opening in the platform, by a collar formed on the pipe and having a horizontally extending circumferential surface; a hoist carriage, reciprocally, vertically movably supported by the platform and having a central opening therethrough, in line with the central opening of the platform; pipe string support means, secured to the hoist carriage and arranged to engage a collar (having a horizontally extending circumferential surface), the collars being on segments of the pipe string; the pipe string support means are secured to and extend outwardly towards each other from the adjacent surfaces of the platform and the hoist carriage, respectively, whereby the two pipe string support means can simultaneously support the pipe string from two collars spaced apart a distance just exceeding the total thickness of the support means. The system further comprises a lower centering guide, for restraining the pipe string from transverse horizontal movement, the lower centering guide preferably being located a substantial distance below the supporting platform, at or beneath the bottom of the hull of the surface vessel. Preferably, there are provided two lower centering guides, arranged so as to permit alternating engagement with the pipe string at or beneath the lowest portion of the hull of the vessel, so as to permit substantially continuous lateral support, regardless of any obstructions or paraphernalia attached along the length of the pipe string.

The pipe string, intended to be supported by the system of this invention, is generally formed of individual pipe segments which are connected together to form the string. The connections are preferably by clamping means, which do not require rotation of the pipe. Such clamp means include, generally, horizontal surfaces which extend radially outwardly from the major surface of the pipe, and which can provide the necessary support ledges to interconnect with the supports of this invention. Generally, each pipe segment is approximately from about 20 to about 40 feet in length. The horizontal ledges at the clamp means, at the junction of two pipe segments, can provide close-coupled horizontal ledges as close as approximately 10 inches apart, and can thus be supported by adjacent support means, wherein the support means are less than 10 inches in thickness. It is preferred that the supporting ledges be as close together as possible, taking into account the spacing required for the various clamping members involved.

The invention defined herein is exemplified by the embodiments described hereinbelow and depicted in the accompanying drawings. The preferred embodiments are presented herein to provide a more clear understanding of the invention and its advantages, and not to limit the scope of the invention.

Figure 14:
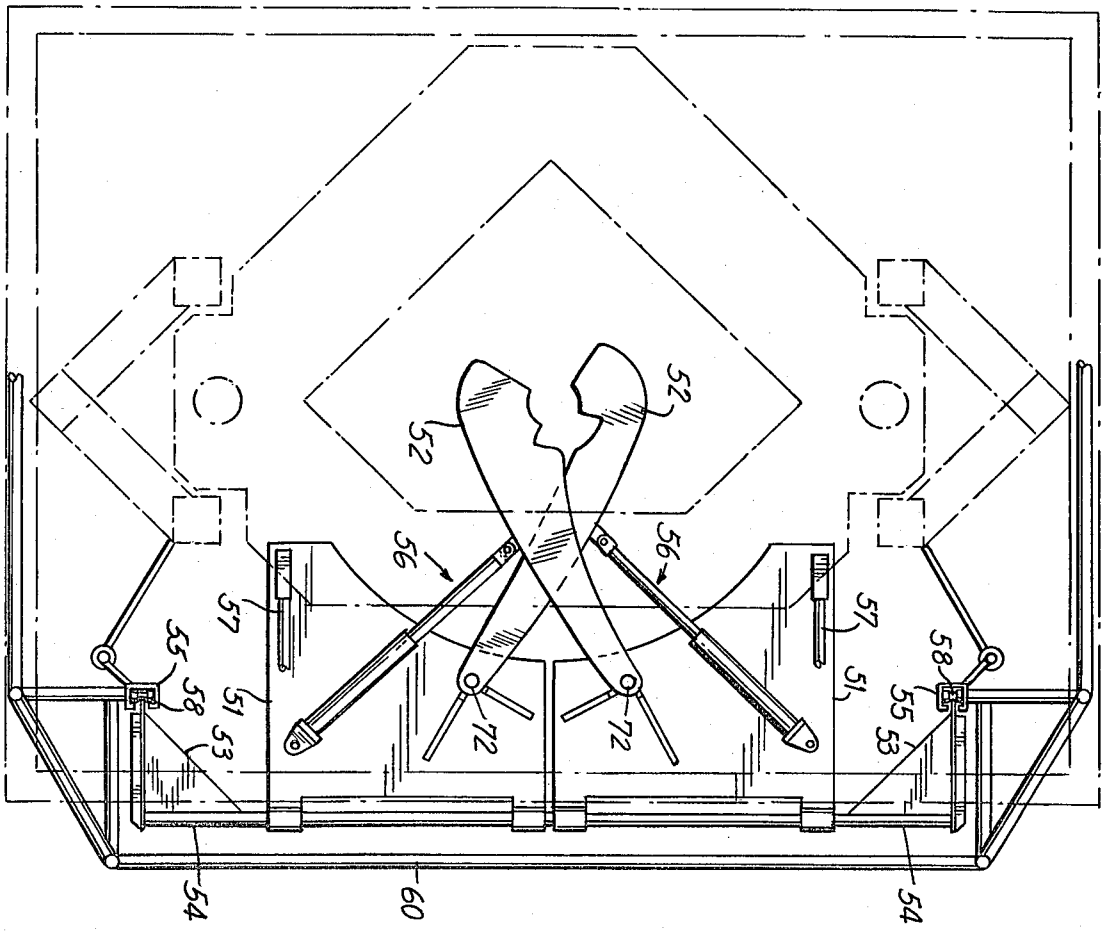
Figure 15:
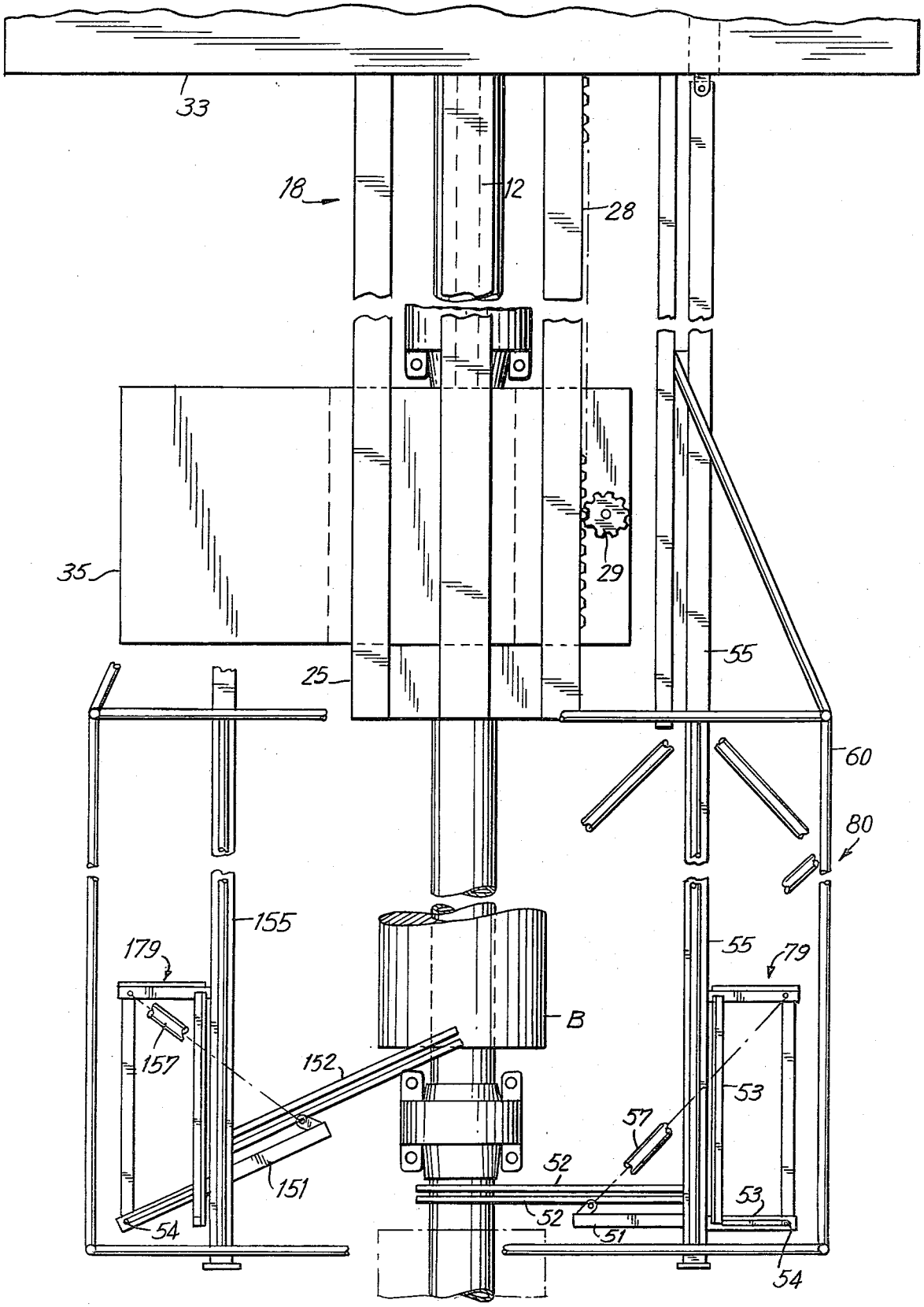

FIGS. 13*a*–13*f* are diagrammatic front elevation views showing the operation of the system of this invention;

FIG. 14 is a top plan view of another embodiment of lower centering guide of this invention; and FIG. 15 is a side elevation view from lines 15—15 of FIG. 14.

DETAILED DESCRIPTION

Figure 1:
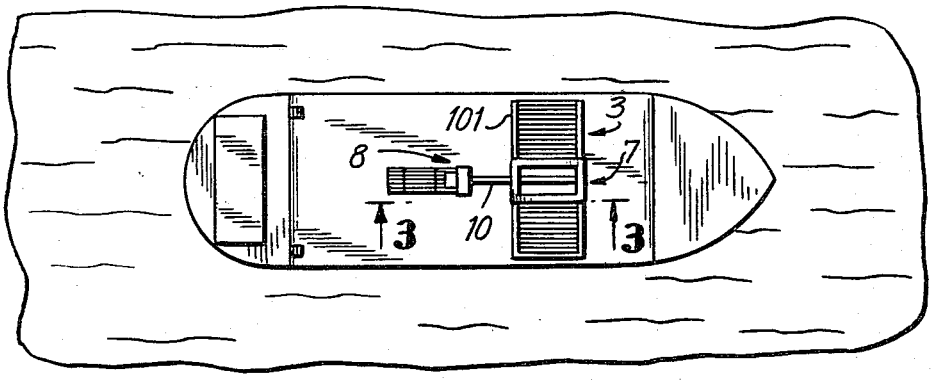
FIG. 1 is a diagrammatic plan view of an ocean-going vessel fitted for ocean floor mining operations.
Figure 2:
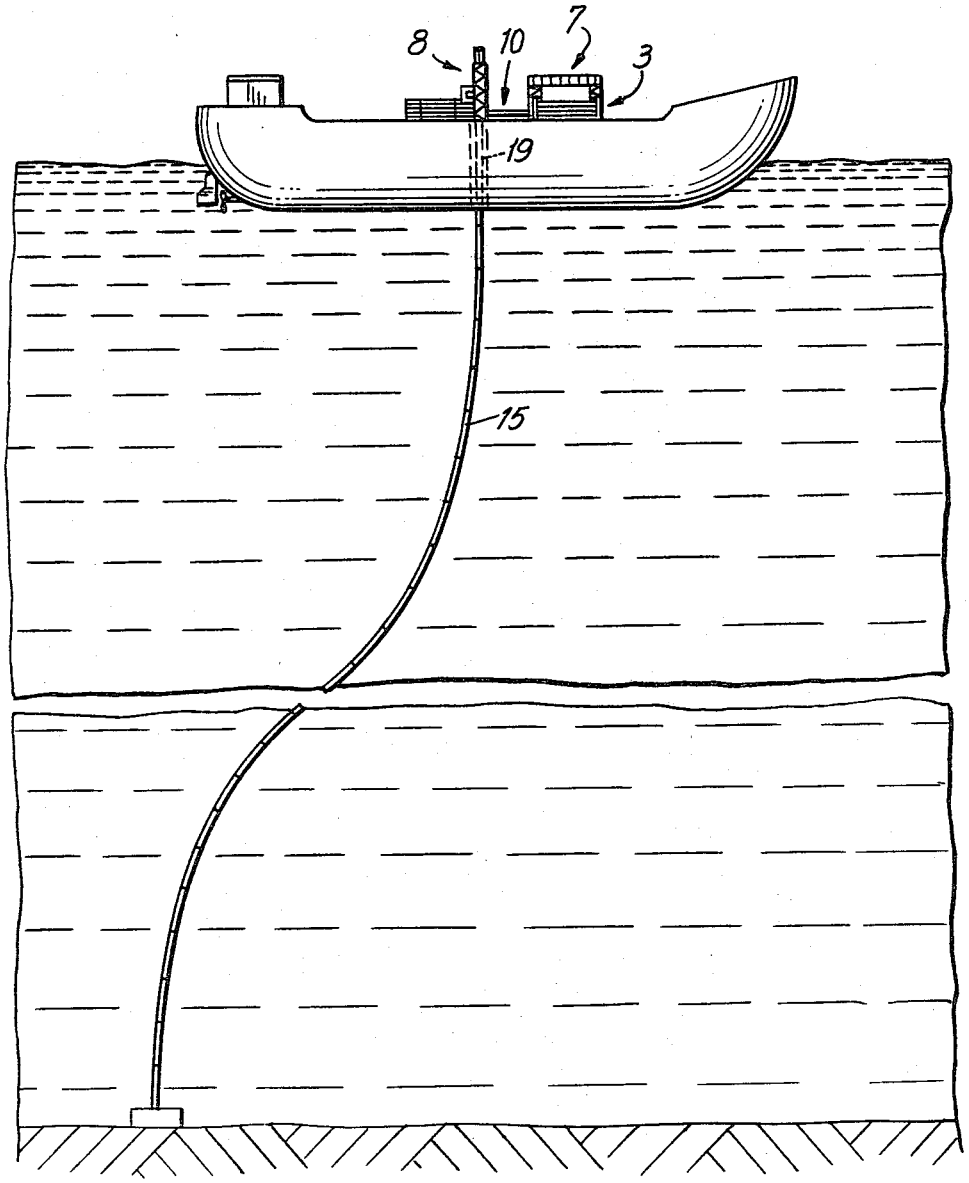
FIG. 2 is a side elevation of the vessel of FIG. 1, moving along the surface of the sea, and including a downwardly and rearwardly extending pipestring, extending towards the ocean floor and connected at its lower end to an ocean floor dredge vehicle.

FIGS. 1 and 2 show a plan and side elevational view of an ocean-going vessel designed specifically for use in ocean floor mining operations. Unusual features on this vessel, distinguishing it clearly from ordinary ocean-going vessels, are shown in the drawings. These special features include a large central opening, or well, extending from the deck of the vessel through the bottom of the hull of the vessel. The well is fully enclosed, having interior wall surfaces maintaining the integrity of the vessel's hull covering. Extending above and below the deck opening are a superstructure and substructure (which extends through the well), which can be generally called upper and lower derricks, their locations being generally indicated by the numerals 8 and 19. The derricks 8, 19, and associated pipe handling systems are mounted upon a platform 33 which is pivotable relative to the vessel about two horizontal, transverse (substantially perpendicular) axes. The derricks 8, 19, including their associated systems, are supported by the inner gimbaled platform 33, which is pivotally supported by a gimbal axis 34 to an outer gimbal ring 32, which is in turn pivotally supported on an outer gimbal axis 31, supported on the surface vessel. Thus, the derricks 8, 19 are pivotally connected to the surface vessel about two transverse, i.e., perpendicular, axes, which compensate for the pitch and roll of a vessel under even the extreme conditions often met with on the ocean, thereby permitting the derricks 8, 19, to remain substantially continuously vertical regardless of the pitching and rolling motion of the vessel.

As can be seen from the drawings, the outer gimbal axis and the inner gimbal axis are preferably substantially located along the longitudinal centerline and the lateral centerline of the vessel, so as to minimize the effect of the rolling and pitching motion in causing relative movement between the inner gimbaled platform 33 and the vessel. The vertical axis of the derricks 8, 19, is thus located at substantially the center point of the vessel, i.e., the intersection of the longitudinal and lateral axes. FIG. 2 shows the dredge pipe string extending downwardly from the vessel to the ocean floor, trailing behind the vessel as the vessel is continuously moving forward, pulling an ore-gathering device, at the end of the dredge pipe line, resting on the ocean floor.

The structure of the upper derrick 8 is formed about a pair of main hydraulic hoist cylinders 11 also supported on the inner gimbaled platform 33, and, in this embodiment, extending upwardly therefrom. The axis of rotation of the platform 33 extends along the diameters of both of the hydraulic hoist cylinders 11, i.e., both cylinders 11 are centered on the axis of rotation 34 of the inner gimbal 33.

The main hoist piston rods 12 extend downwardly through the lower derrick framework 18 from, and slidably connected inside of, the main hoist cyclinders 11. Suspended from the main hoist piston rods 12 is a hoist carriage 35, which moves together with the piston rods 12, vertically, towards and away from the gimbaled platform 33, and guided within the lower derrick structure 19. The two hoist cylinders 11 are hydraulically interconnected, in a manner known to the art, to maintain, as much as possible, the movable hoist carriage 35 in a level position relative to the inner gimbaled platform 33, i.e., the two hoist piston rods 12 move together in an upwardly and downwardly direction.

The lower derrick structure 19 includes a pair of tracks 28, having square-cut teeth formed along one surface of each track. The tracks 28 extend on either side of the movable hoist carriage 35 along the derrick structure 18. Rotatably secured along one end of the carriage 35 and extending between the tracks 28, is a pinion rod axle 22 having secured to each end thereof pinion gears 29, in contact with and having square-cut teeth complementing, the teeth on the tracks 28. The pinion rod 22 is shown secured to the carriage 35 by bearing supports 23. The movable carriage 35 is vertically guided along the lower derrick 18 by the guide rails 25, to protect the carriage and the piston rods from lateral stress.

The lower end of lower derrick structure 18 extends substantially to or just below the bottom of the hull of the vessel. At the lower portion of the lower derrick 18 is located the lower centering guide, generally indicated by the numeral 38 in FIG. 3. The embodiment of FIGS. 14 and 15 includes a portion of the lower derrick structure 18 extending below the hull of the vessel.

Supported from the lower horizontal surface of the inner gimbaled platform 33 is the pipe string support means, in this embodiment a segmented support means comprising four pipe support plates 36. The four plates are located adjacent a central opening through the gimbaled platform 33, defined by interior surfaces 20. Each plate is supported so as to be reciprocally, radially movable relative to the centerline of the pipe string extending through the well 20 of the gimbaled platform 33. Each support plate 36 is thus movably supported at its forward, or innermost portion, by a heavy duty bracket 37, firmly secured to and extending radially inwardly from the well surface 20. A lighter supporting strap 30 is secured against the radially outward portion of the massive support plate 36, and secured to the undersurface of the gimbaled platform 33. Held in vertically extending slots 136 along the sides of the support plates 36 are replaceable stop members 61, which abut against a proximity sensor and stop member 62 secured to the lower surface of the gimbaled platform 33 and abutting at one end against the primary support bracket 37. At the radially outwardmost end of the support plate 36, a piston rod 63 is secured by a pin joint and in turn is slidably connected into hydraulic cylinder 64, secured to the gimbaled platform 33. To one side of the latch plate 36 and pivotally secured to the lower surface of the gimbaled platform 33, is a mechanical locking means 65 secured to the gimbaled platform 33 by rotatable pin 66. One end of the generally boomerang-shaped locking means 65 is so arranged as to butt up against the outward end of stop member 61 when the support plate 36 is in supporting position to a suitably sized pipe collar; the other end of the lock member 65 is connected to a locking piston rod 67 by a pin joint, and the piston rod 67 is in turn slidably secured within hydraulic cylinder 68, secured to the platform 33.

Figure 6:
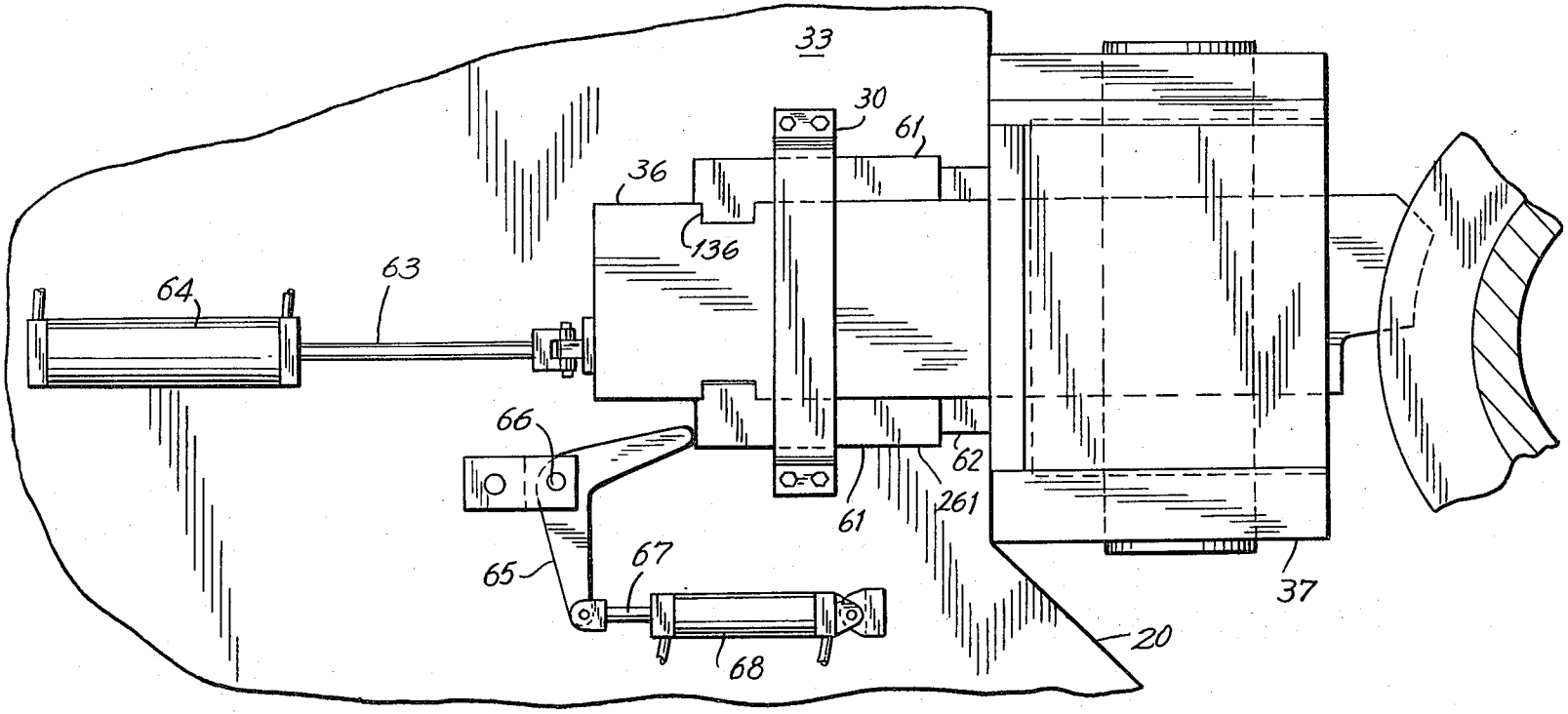
FIG. 6 is a bottom plan view of one portion of the gimbaled platform.

The radially inwardmost end of the massive support plates 36 are each preferably conformed to the particular configuration of the pipe string collar being supported. As shown in the embodiment of FIG. 6, a portion of a corner of the inwardmost end is cut away, to conform to the particular pipe joint there being supported. The particular configuration, however, does not form a part of this invention.

The moving hoist carriage 35, in the embodiment of the drawings herewith, moves vertically upwardly and downwardly between positions below the gimbaled platform 33. Accordingly, support plates 43 on the moving carriage are reciprocally radially movably supported on the upper surface of the moving carriage 35. A longitudinal groove 45 is formed along each side of the support plates 43. Support plate slide holders 44, 144, are rigidly secured to the upper surface of the moving carriage 35 and extend into the groove 45 along the support plate 43, securing the plate 43 on the movable carriage 35. A further support 17 extends upwardly from the central opening through the carriage 35 to support the inwardmost portion of the plate 43 when it is extended radially inwardly in a supporting position for pipe.

A stop member 46 is replaceably secured on either side of the radially outwardmost end of the support plate 43 and held in position in a vertically extending slot 146. Secured to the radially outwardmost end of the support plate 43, in the same manner as described above for the platform latch plates 36, is a hydraulic piston rod 48 secured within a hydraulic cylinder 49, which is in turn secured to the hoist carriage 35. Mechanical locking means, generally indicated by the numeral 47, act in the same fashion as the locking means 65 described for the upper support plates above. One end of the generally boomerang-shaped unit abuts against the outermost end of the stop member 46, in the locking position, shown; the other end of the stop member 46 is pinned to an hydraulic cylinder and piston rod, generally indicated by the numeral 147, to pivot the stop member 47 into and out of the locking position.

Figure 9:
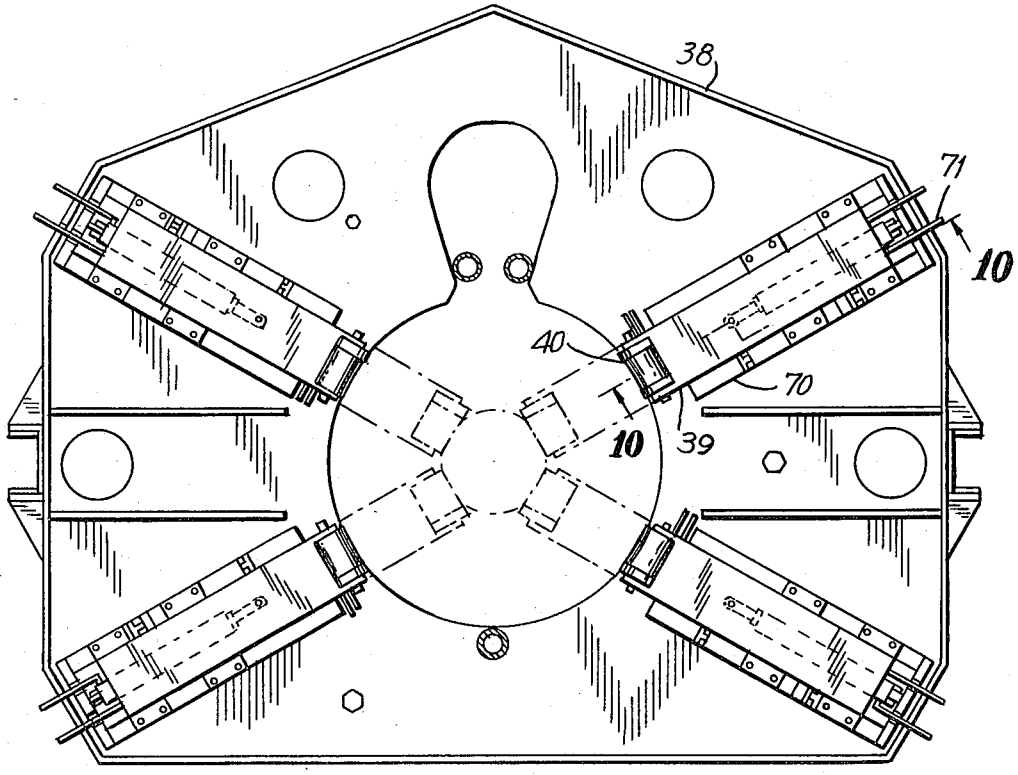
FIG. 9 is a plan view of one embodiment of lower centering guide.
Figure 10:
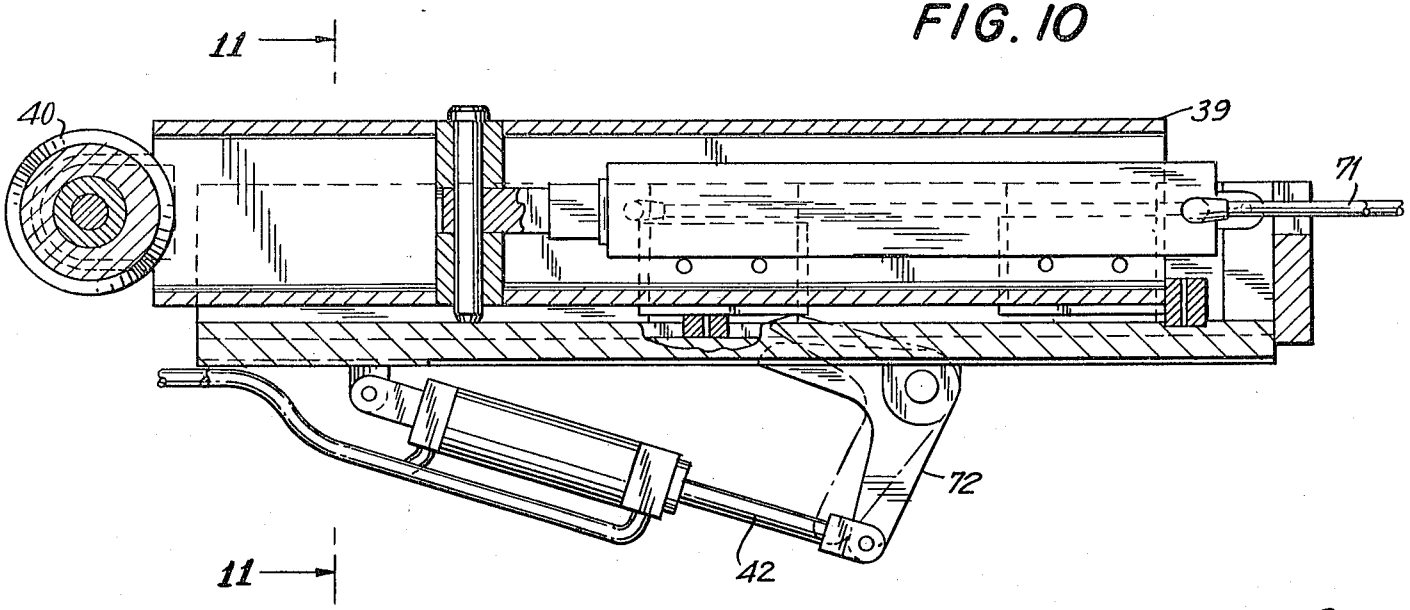
FIG. 10 is a sectional view along lines 10—10 of FIG. 9.
Figure 11:
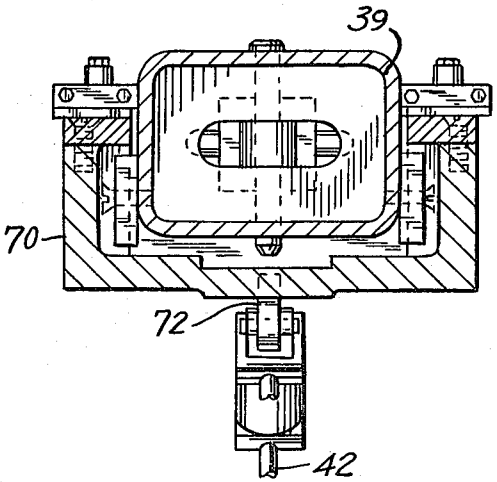
FIG. 11 is a sectional view along lines 11—11 of FIG. 10.

Moving farther down the lower derrick 19, to the lowest end of the structure 18, there are provided two sets of lower centering guides 38, 138. FIGS. 9–11 depict centering guide 38. However, the lower centering guide 138 is substantially identical thereto, but located downwardly thereof on the lower derrick structure 18. The lower centering guide frame 38, 138 is rigidly supported on the main derrick structure 18, and parallel to the moving hoist carriage 35 and gimbaled platform 33. A set of four guide plates 39 are reciprocally, radially movably secured to the upper surface of the guide frame 38, moving within four complementary slide ways 70, which are in turn rigidly secured to the guide frame 38. Each of the guide members 39 are moved radially inwardly and outwardly by hydraulic actuators, indicated by the piston rods 71, secured to the radially outwardmost end of each guide plate 39. Rotatably secured to the radially inwardmost end of each guide plate 39 is a roller 40 secured about a pin extending parallel to the guide frame 38. The circumferential surface of each roller 40 is generally concave, in order to fit easily about a circular pipe.

Each guide plate 39 can also be locked into its guide position, i.e., as shown by phantom lines in FIG. 9, in contact with a pipe surface, by the hydraulically actuated mechanical stop member 72, actuated by hydraulic piston rod 42, below the guide plate 39.

The central opening through the guide frame 38 is formed in the shape of a keyhole slot, in this instance, in order to accomodate pipe having the configuration shown in copending application Ser. No. 910,424, (including a main dredge line pipe and a secondary air line pipe, plus a pivotable splitter plate pivotally connected to the secondary air line pipe and extending radially outwardly from the pipe). The slot in guide frame 38 is intended to accommodate the outwardly extending splitter plate.

A second lower centering guide, according to this embodiment is provided secured below the guide frame 38, and is of substantially identical configuration. The guide means are so arranged as to open alternatively as a pipe joint passes downwardly, first past one then past the second guide member.

Figure 12:
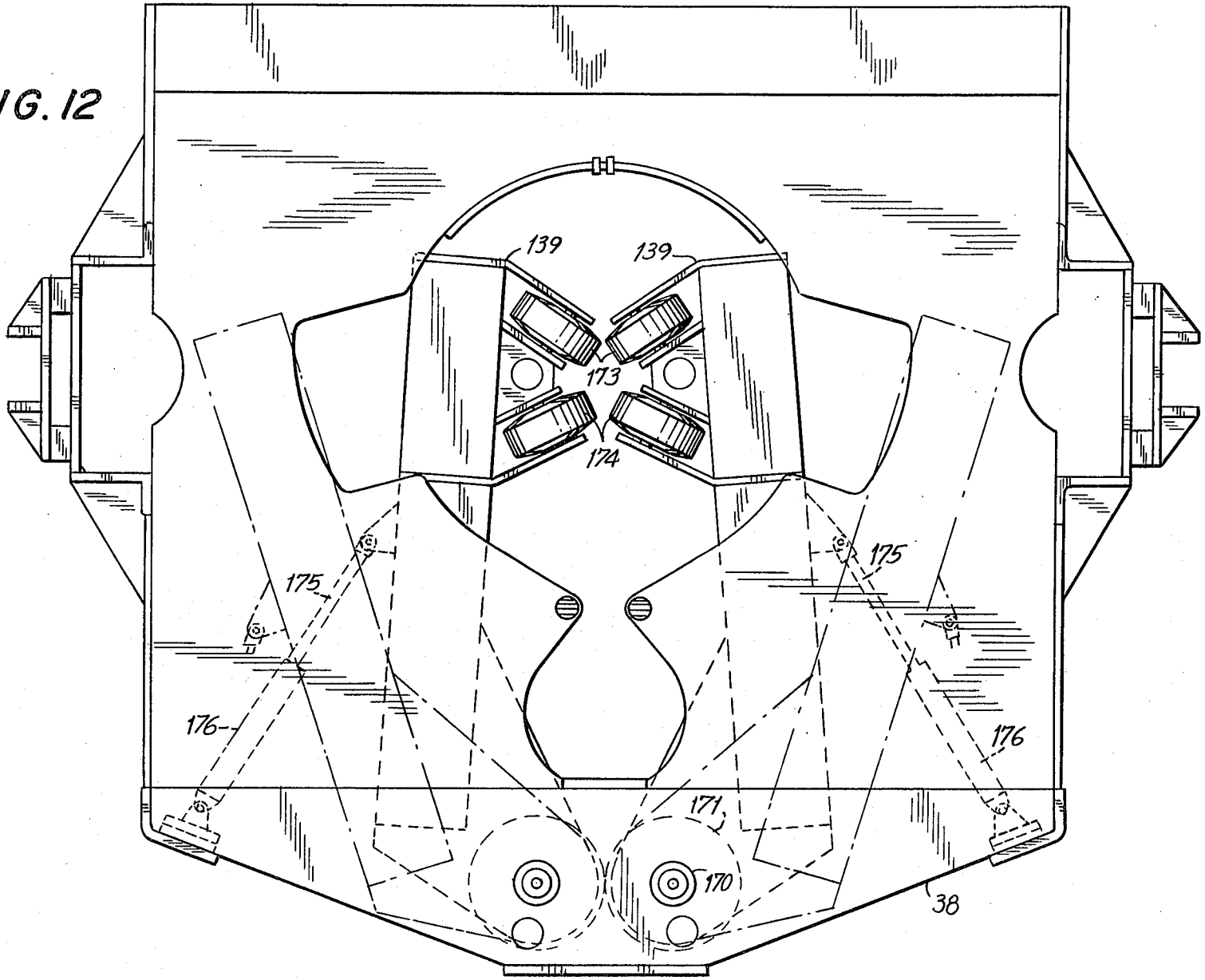
FIG. 12 is a plan view of a second embodiment of lower center guide.

A second example of the vertically fixed pair of centering guides is shown in FIG. 12. In this embodiment, the guide frames 38, 138 have pivotally secured to their lower surfaces a pair of swing arms 139, pivotally pinned to the frames 38, 138 at one end 170, and interconnected at the same end by spur gears 171. A pair of rollers 173, 174 are rotatably connected to the second end of each arm 139, placed so that the circumferential surface of each roller 173, 174 faces radially inwardly of the central keyhole slot of the frame 38, 138. A piston rod 175 is pinned to an intermediate portion of the radially outward surface of each arm 139. Each piston rod 175 is in turn slidably secured within a hydraulic cylinder 176, secured to the frame 38.

Another embodiment of lower centering guide is shown in FIGS. 14 and 15, where two vertically movable guide means are depicted. This embodiment provides for a pair of vertically movable centering guides, which can be moved independently of each other and of the pipe string. Referring to the drawings, a special centering guide framework, generally indicated by the numeral 80, extends below the track and structure 18 for guiding the movable hoist carriage 35. The centering guide framework 80 includes two pairs of vertically extending track means 55, 155, extending from a position at the top of the lower derrick structure 18 down to the bottom of the guide framework 80. Slidably secured to the tracks 55, 155, are a pair of centering guide carriages, generally indicated by the numerals 79, 179. Rollers 58, rotatably secured to the guide framework 79, 179, roll within the guide tracks 55, 155. Along the lower end of each guide carriage 79, 179, is secured a guide platform axle 54. The guide platforms 51, 151, are rotatably secured to the axles 54, so as to be able to pivot about the axles 54 upwardly and radially outwardly from the pipe. Scissors-type centering guides 52, 152, are pivotally secured to the guide platforms 51, 151, about pins 72 and can be pivoted towards and away from the pipe string by hydraulic cylinders 56 to move from a closed position about a pipe, as shown in FIGS. 14 and 15, to an open position where the ends swing apart and move towards the platforms 51, 151. Hydraulic-actuating cylinders 57, 157, connect the radially inwardmost end of the platform 51 and the upper outward corner of the guide carriage 79, and can be actuated to cause the platform 51 to swing upward and outwardly. Motor-driven cables, not shown, are used to move the centering guide carriages 79, 179, vertically upwardly and downwardly along the tracks 55, 155.

The centering guide framework 80 is preferably made to be retractable upwardly into the hull of the vessel, when the dredging string is not supported by the derrick. This is to eliminate any possible navigational hazard when the vessel returns to port or otherwise travels into shallow waters. The ability to retract can be provided by, e.g., a means for telescoping the lower portion of tracks 55, 155 into the upper portion of the tracks while raising the framework 80 and the centering guide carriages 79, 179.

OPERATION OF THE SYSTEM

Referring to FIGS. 1 and 2, an ocean-going vessel is shown moving at a relatively slow pace, with a portion of a dredging pipe string extending beneath and behind the vessel, down to an ocean floor dredge vehicle, which moves as the vessel moves in a forward direction. The pipe string 15 is supported by the pipe support means on the inner gimbaled platform 33, or on the moving hoist carriage 35. It shall be assumed, unless otherwise specified, that pipe having the general configuration shown in copending application Ser. No. 910,424, referred to above, including a pivotable splitter plate, is being supported by the support system of this invention, the operation of the system shall be described in the context of adding additional pipe segments to the pipe string, in order to increase the string. During this operation, the pipe string is gradually let down by the pipe string support system further towards the ocean floor.

Figure 3:
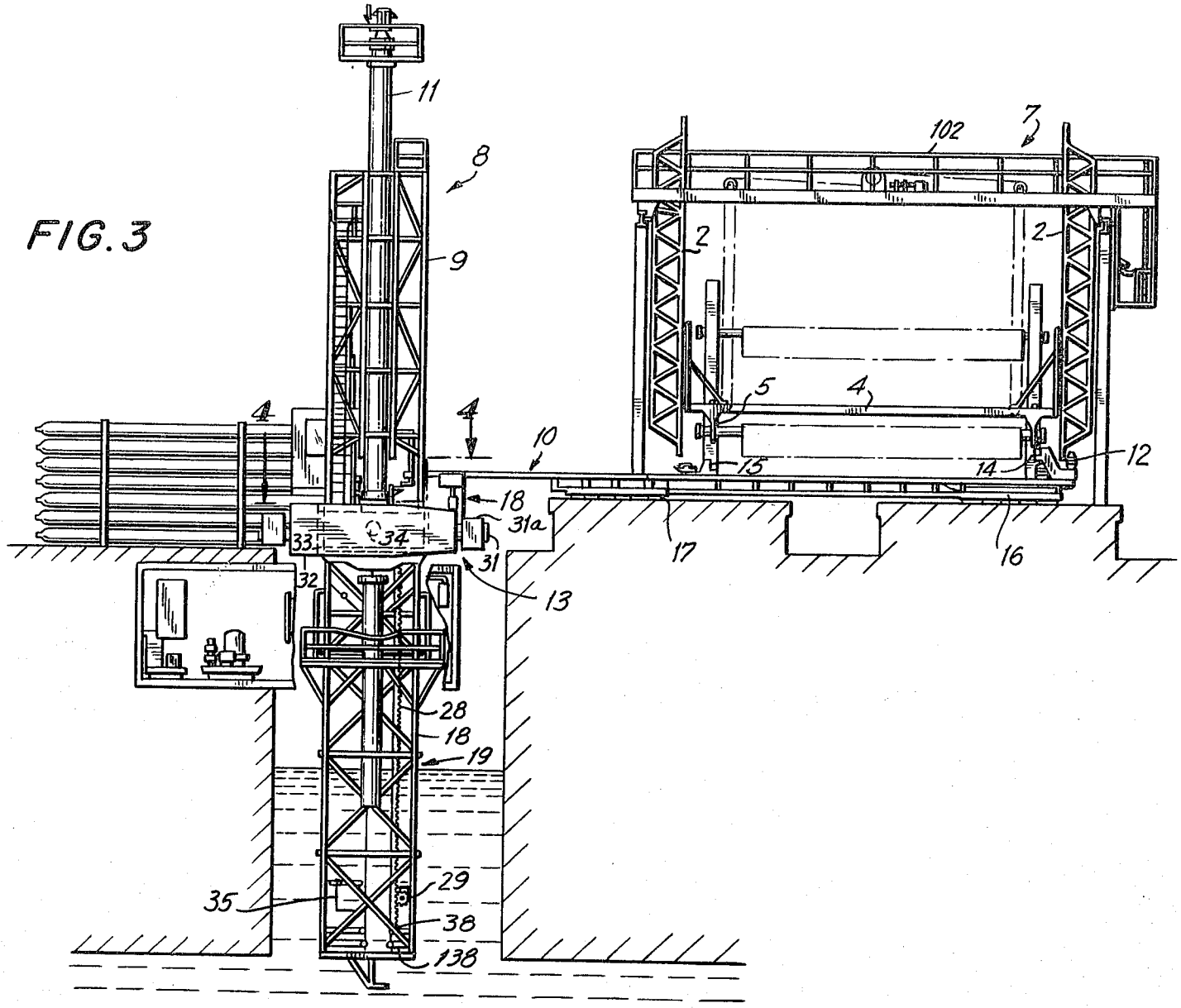
FIG. 3 is a side elevation of the portion of the vessel of FIGS. 1 and 2, comprising the pipestring support system.
Figure 4:
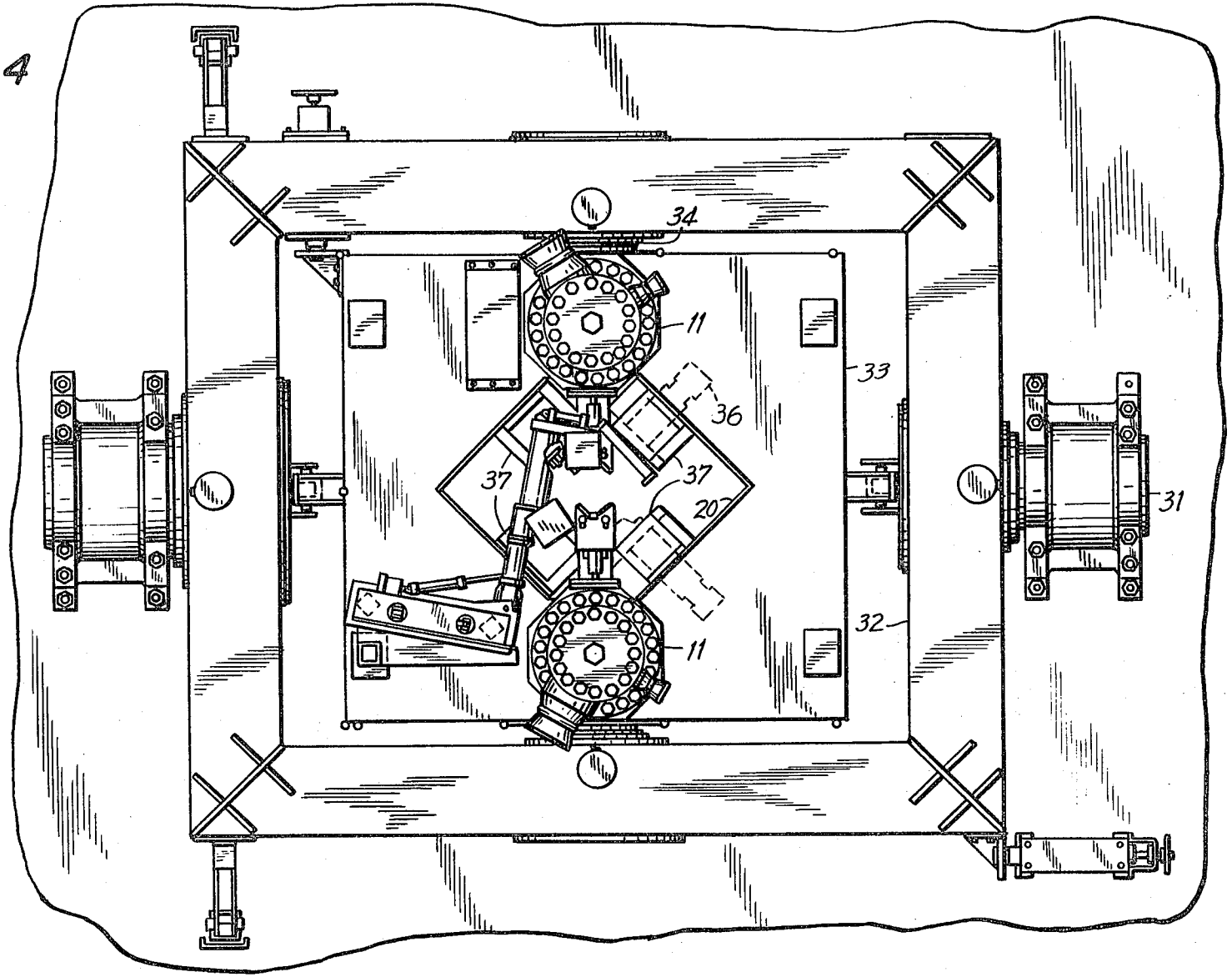
FIG. 4 is a cross-sectional view taken along lines 4—4 of FIG. 3.
Figure 5:
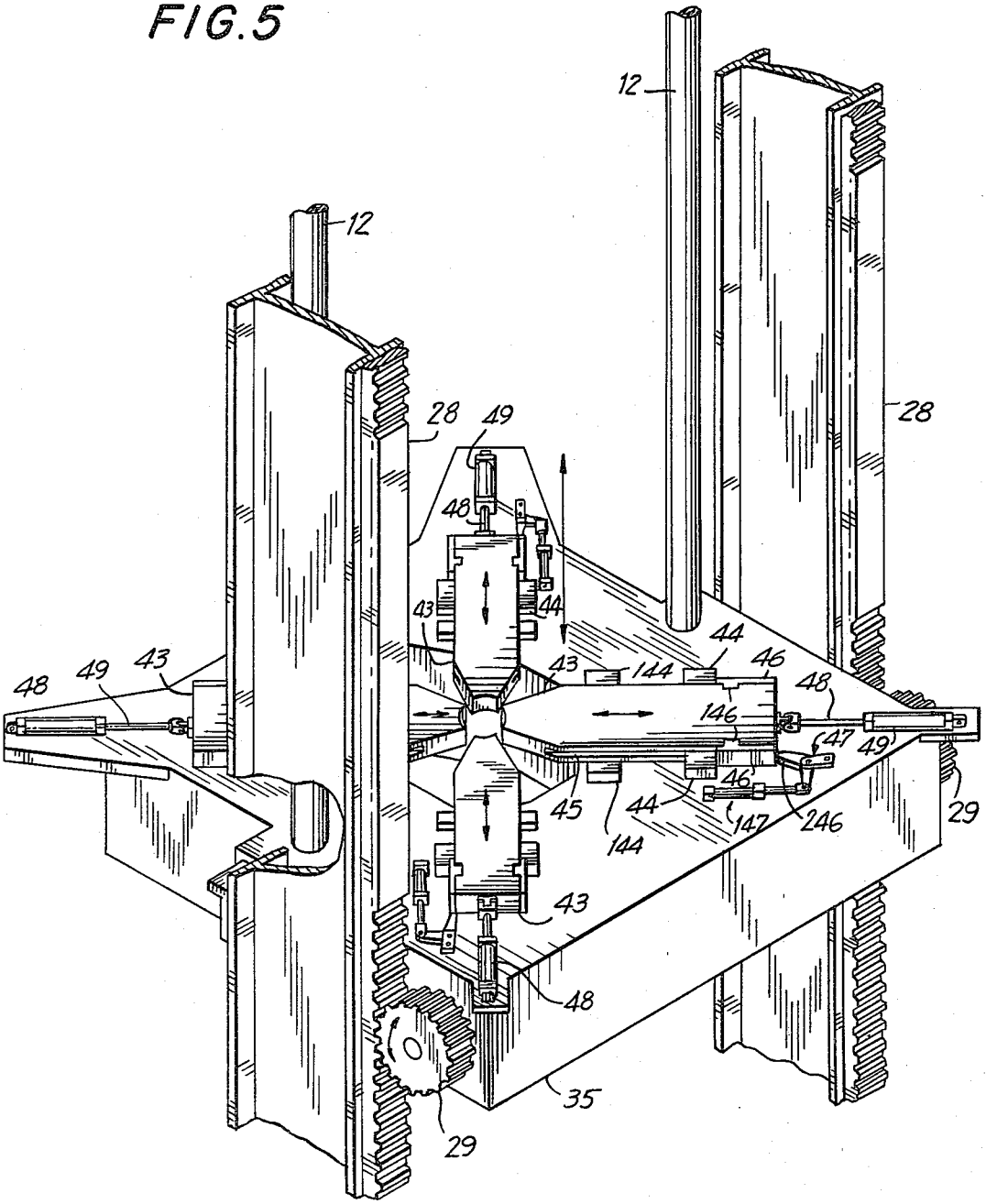
FIG. 5 is an isometric view of the lower structure of FIG. 3.
Figures 13A, 13B, 13C:
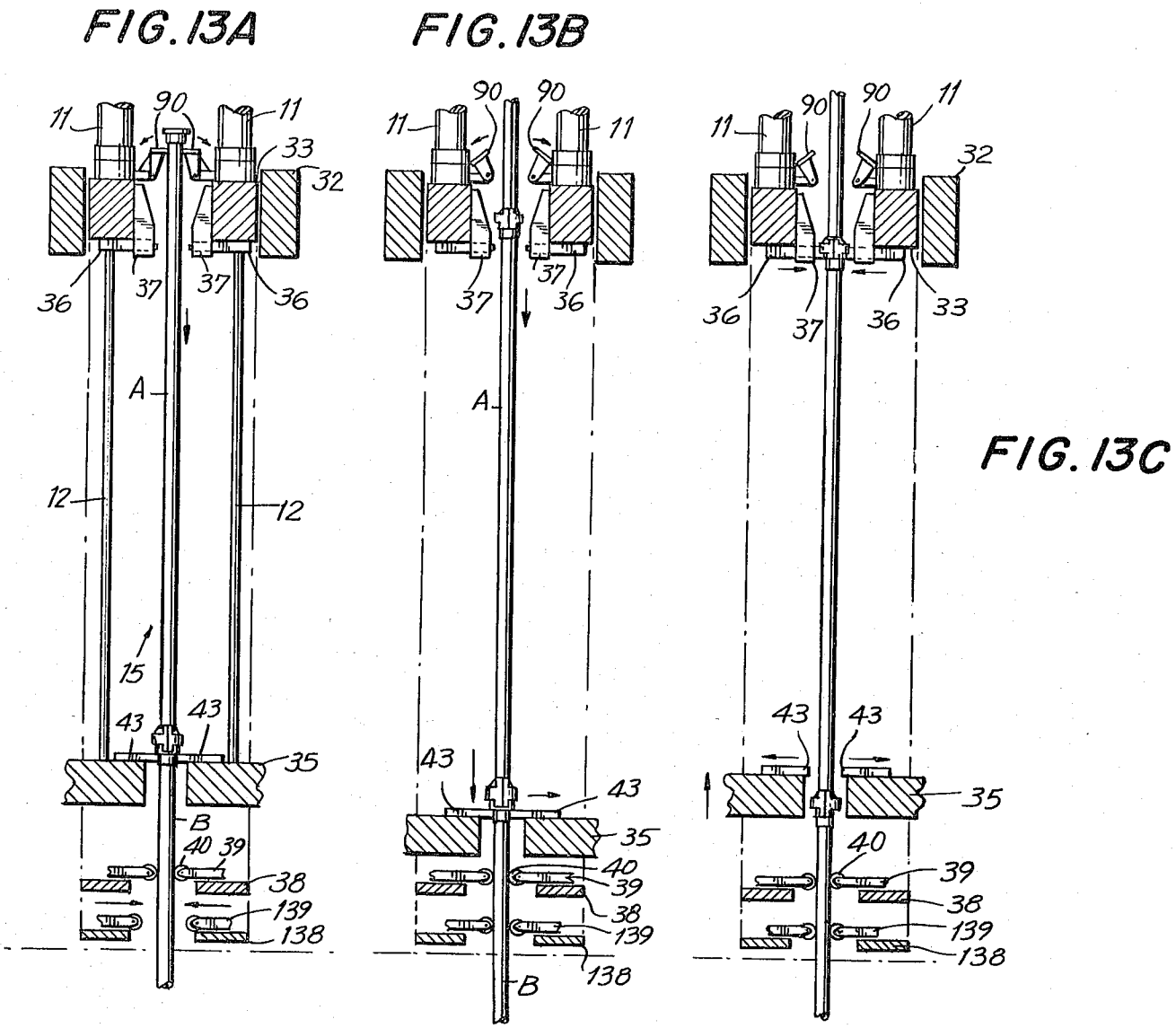

The drawing of FIG. 3, shows portions of apparatus on the surface of the vessel, which do not form a part of this invention, but which can be used for bringing additional segments of pipe from a storage location on the surface vessel to the vertically upwardly extending upper derrick 8, to place in a position suitable to add to the pipe string 15, in the manner shown in FIGS. 13*a*–13*f*. In the position of the pipe string shown in FIG. 13*a*, the main weight of the pipe string 15 is supported from a collar on the second pipe segment B by the support plates 43 on the moving hoist carriage 35. The guide plates 39 of the first lower centering guide 38 are in position such that their roller ends 40 are in contact with the second segment, pipe B, to prevent lateral movement of the pipe string relative to the carriage means 35 and the lower derrick structure 19, and the guide plates of the lower centering guide 38 are moving inwardly. The top of the first segment A of the pipe string 15 is also laterally supported, in this case by the upper centering guide 90, pivotally secured to the upper surface of the inner gimbaled platform 33 and manually movable, as shown in FIG. 13*b*.

As shown in FIG. 13*b* an additional section of pipe C, which is vertically suspended by an elevator means in the upper derrick, is joined to the top of pipe segment A, as more fully described in a copending, commonly assigned application entitled "PIPE TRANSFER SYSTEM MEANS". As soon as the new section of pipe C has been secured by its clamp means to the pipe string to form joint AC, the upper centering guide 90 opens to permit the joint AC to move downwardly therebetween as the carriage hoist 35 moves downwardly, as shown in FIG. 13*b*.

As shown in FIG. 13*c*, the pipe string 15 has been lowered to a position where the ring clamp at pipe joint AC, between sections A and C, is level with the platform support plates 36. The support plates 36 are moved radially inwardly, by activating hydraulic cylinder 64, to a position beneath the ring clamp D, and locked into the supporting position by pivoting locking member 65 to the position shown in FIG. 6, by activating hydraulic cylinder 68. The carriage 35 continues to move the pipestring 15 downwardly until the pipe-string 15 is supported from the pipe joint ring clamp D by the pipe-string support plates 36 on the inner gimbal 33; the carriage support plates 43 move radially outwardly, as shown in FIG. 13*c*.

Figure 8:
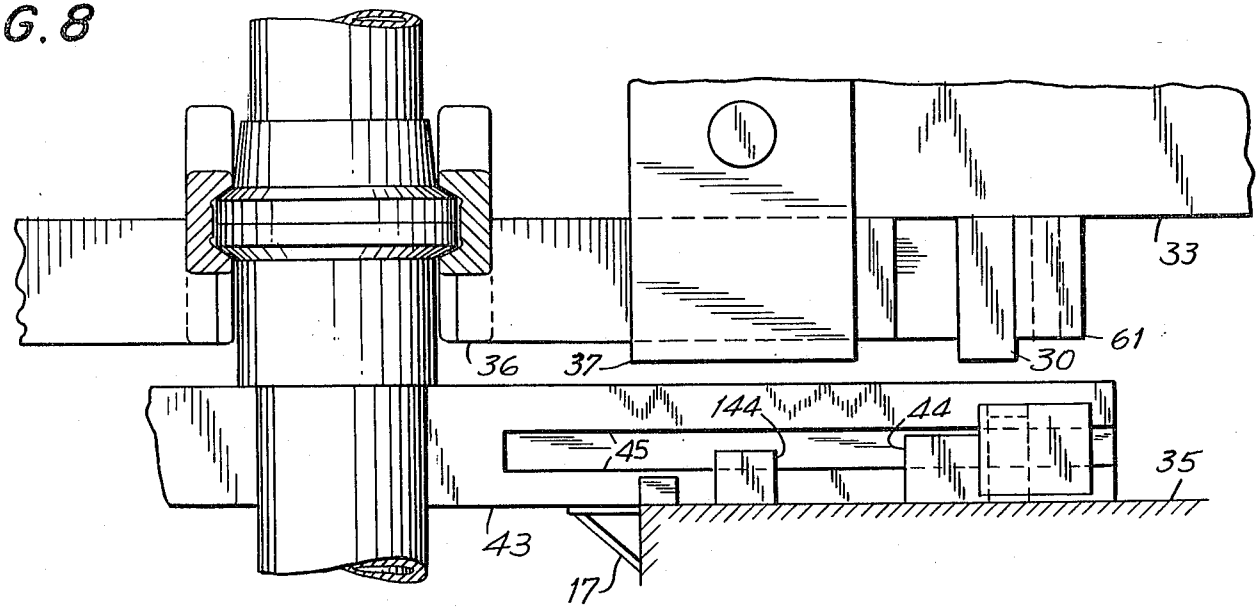
FIG. 8 is a cross-sectional view showing a portion of the movable and stationary pipestring support means in close juxtaposition.
Figures 13D, 13E, 13F:
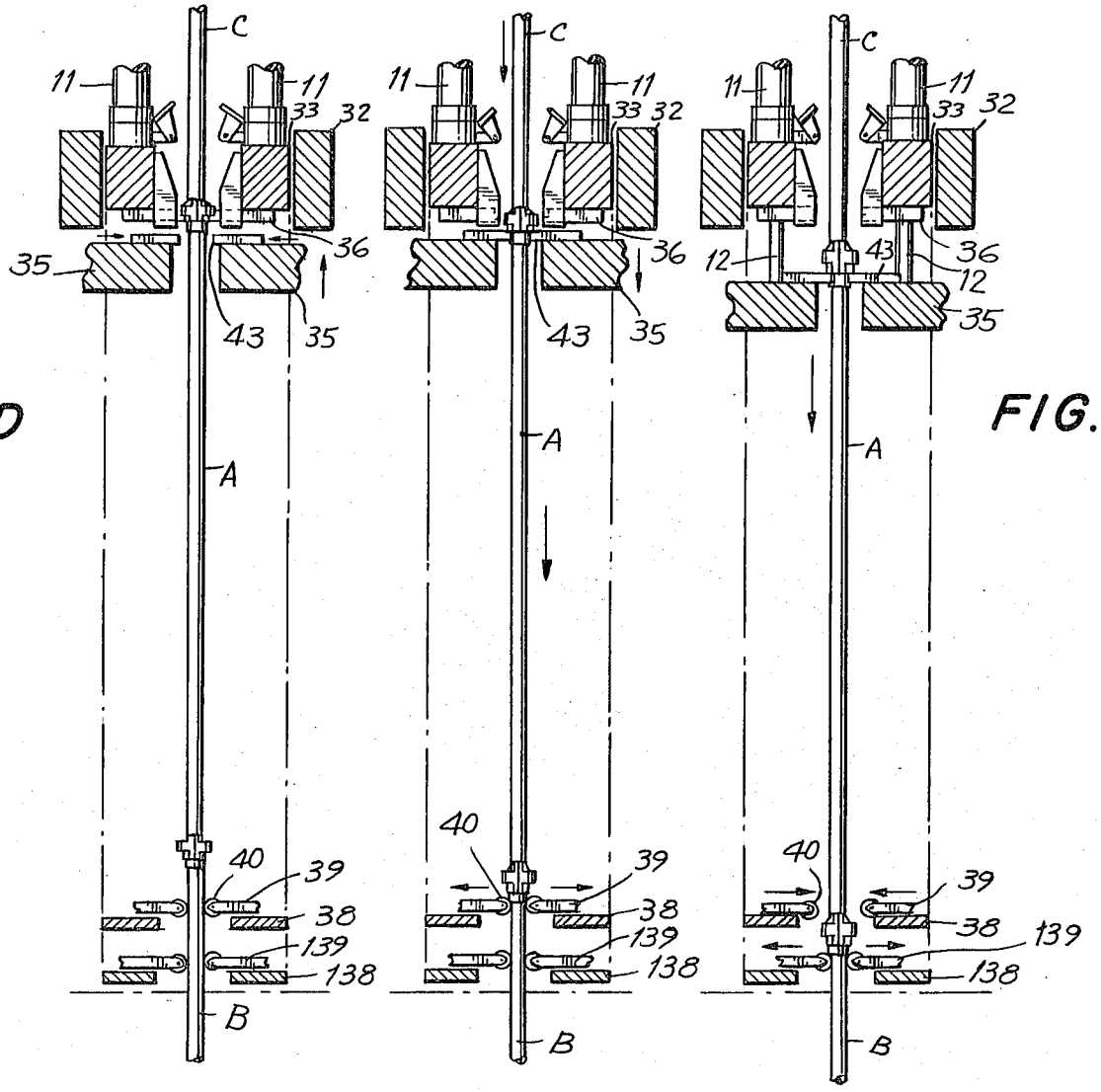

The moving hoist carriage 35, after the support members 43 have released the pipestring collar, moves upwardly, to the close-coupled position shown in FIG. 13*d*. During this time, the pipestring 15 is vertically motionless, relative to the vessel, and, if desired, both of the lower centering guides 39, 139, continue to be in the closed position, as shown in FIGS. 13*c* and 13*d*. When the moving hoist carriage 35 has moved up to close proximity to the inner gimbaled platform 33, as shown in FIG. 13*d*, the pipe support members 43 move radially inwardly until they extend beneath the ring clamp D as shown in FIGS. 8 and 13*d*. The support plates 43 are then locked in position by operating the hydraulic unit 147 so as to move the mechanical locking member 47 into position against the stop member 46, as shown in FIG. 8. The hydraulic unit 68 is then actuated in the reverse direction so as to move the locking member 65 from out of contact with the stop member 61 on the inner gimbal ring 33, and the upper support plates 36 are then withdrawn from under the collar 17 on the pipe string 15 by actuation of the hydraulic unit 64. It is generally advisable to have the movable hoist carriage 35 move upwardly an inch or less in order to remove the weight of the pipe string from the upper support means 36 before they are moved radially outwardly. The moving hoist carriage 35 moves downwardly with piston rods 12, moving the pipe string 15 downwardly. As the pipe joint AB reaches the uppermost centering guide 38, the guide plates 39 must move outwardly, as indicated by FIG. 13*e*, to permit the pipe joint AB to pass. As the joint AB passes, the guide plates 39 can then immediately move inwardly and the lowest guide plates 139 move outwardly to permit the joint AB to move further downwardly, as is indicated in FIG. 13*f*. As the cycle continues, the carriage 35 returns to the position shown in FIG. 13*a*, with pipe section A being in the position shown for section B and segment C, in the prior position of segment A.

When the pipe string has been fully let out, and the dredge vehicle is resting on the ocean floor for dredging purposes, the pipe string is preferably supported on the moving hoist carriage 35, in order to obtain compensation caused by the heaving movement of the vessel due to the wave action of the ocean. Such heave compensation can be provided by the main hoist cylinder, or alternatively, by an auxiliary set of hydraulic cylinders, not shown.

However, means should be provided for mechanically locking the carriage 35 into a vertical position, especially towards the upper end of its travel. Such means include merely bolting the carriage 35, e.g., to the track 28.

Figure 7:
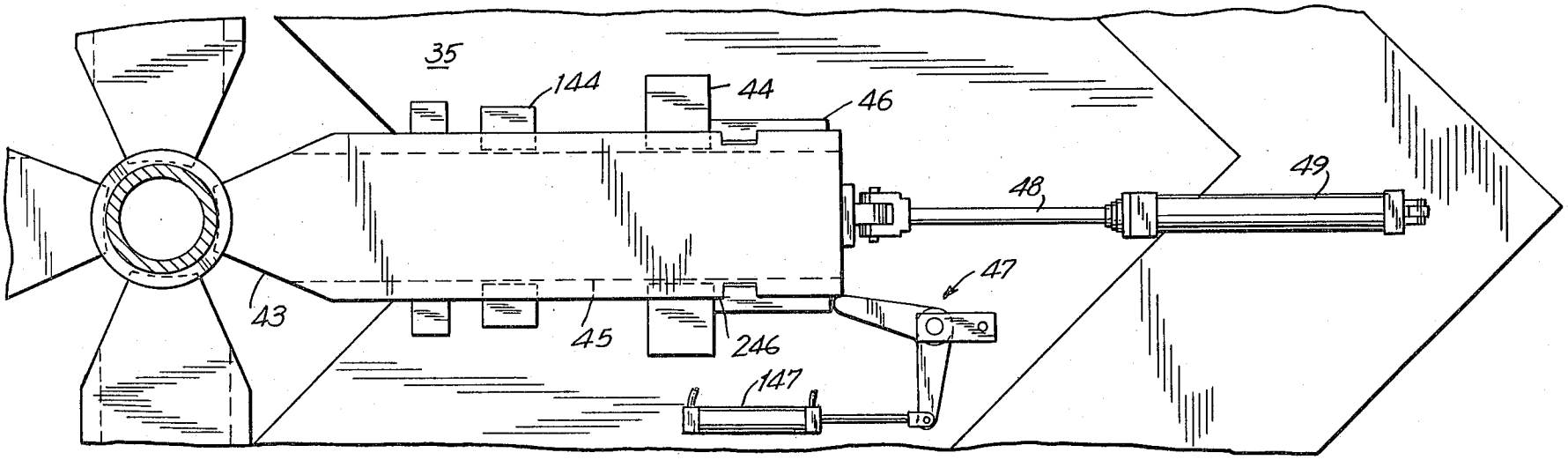
FIG. 7 is an enlarged top plan view of a portion of the carriage of FIG. 5.

Commonly, the outer diameter of the pipe sections increase incrementally as the pipe string is tripped downwardly. This requires different radial locations for the support plates, 43, 36 in the support positions. To insure proper location of these plates, the stop members 46, 61 are replaceable, such that when larger diameter pipe is to be supported the radially inward leg 246, 261 is longer than the radially outward leg (as shown in FIG. 6), and for smaller diameter pipe the reverse is true (as shown in FIG. 7).

When the alternative embodiment of lower centering guide is provided, in accordance with FIGS. 14 and 15, a similar cyclical process is carried out as depicted in FIGS. 13*a*–13*f*. The principal difference between the two embodiments is that the scissors-type centering guides of FIGS. 14 and 15 move with the pipe string as it is moved upwardly and downwardly by the hoist carriage 35. The centering guide carriage 79 is capable of moving vertically substantially the full length of the lower derrick 18, from the position shown in FIG. 15, below the lower derrick main structure, and up to a position which is one pipe segment above the initial location shown in FIG. 15. In actual operation of tripping downwardly, the second scissors centering guide 151 would be located in the lower portion of the derrick 18, so as to laterally support the pipe string at a location above the guide framework 80, and about one full pipe length below the location of the moving carriage, e.g., as shown in FIG. 13*e*. The first guide 51 is located at the level shown in FIG. 15. As soon as the scissors 152 have made contact with the higher pipe segment, also just below the joint clamp, the scissors-type guide 52 is released and swung upwardly out of the way. The pipestring is then moved downwardly by the carriage 35, while being centered by the guide 151, to prevent lateral movement. The guide 151 moves downwardly simultaneously with the pipestring and the carriage 35. The first guide 51 can be moved upwardly to the lower portion of the derrick 18, in the folded away position, simultaneously with the downward movement of the pipe string, or alternatively, after the carriage 35 has reached its lowermost position. The cycle is then repeated as explained above. This type of scissors-centering guide is useful when the pipe is fully enshrouded within, for example, a fairing 101, except for the small portion at the pipe joint clamp, as shown in FIG. 15. The rolling type centering guide of FIGS. 9 through 12, would be likely to cause damage to the fairing if the fairing were pressing against a roller 40 and lateral stress exerted.

Preferably, the centering guides of FIGS. 13*a*–13*f* are separated by a distance of approximately 40 inches, which is more than ample for substantially any type of clamp joint which may be used. The exact dimensions of this separation are not significant; however, it is desireable to have both of the centering guides as low down on the derrick as possible, so that the higher of the two should not be too great a distance above the lower.

What is more significant, is the distance between the support plates on the moving carriage 35 and on the inner gimbal ring 33 during the transfer of loads. Whether the carriage moves vertically above the gimbal ring 33, such that the locations of the support plates are on the reverse surfaces from those shown in the accompanying drawings, or whether the moving carriage 35 moves vertically beneath the gimbaled platform 33, as shown in the accomanying drawings, the support plates should be able to come within not more than about 20 inches of each other, when transferring loads, as shown in FIGS. 8 and 13*e*. The distance must conform to the distance between the close-coupled collars formed on the pipe string 15. The configuration of the load support means in the design of the present invention is such as to permit the close coupling between the two supporting means, on the gimbaled platform 33 and movable hoist carriage 35, respectively, during transfer.

The length of the lower derrick 18 limits the travel of the hoist carriage 35, which must be at least as great as the distance between adjoining sets of close-coupled collars on the pipe string. In the embodiment shown in the drawings, this is approximately the length of one pipe segment. If a shorter length of travel is desired for any reason, extra collars can be formed at arbitrary positions along each pipe section. However, one advantage of the close-coupled support plates of this invention is that the two sets of plates can approach each other sufficiently closely as to enable the utilization of collars, or surfaces, which are inherently present on the clamps, without requiring that special collars be machined.

The system of this invention is also effective when the carriage 35 moves vertically above the gimbaled platform 33, i.e., the piston rods 11 extend upwardly from the platform 33. In that alternative mode, the structures of the support plates would be reversed, and the structure of FIG. 6 would be on the lower surface of the moving carriage and the stucture of FIG. 7 would be on the top surface of the gimbaled platorm 33.

When the scissors type of centering guide is used, as shown in FIGS. 14 and 15, the distance to the bottom of the track 55, must be greater than the length of two sections, or of two separations between pipe collars, from the platform 33.

The new system of this invention is especially suited for dredging from a slowly moving vessel, i.e., in the range of from about 0.5 to about 4 knots forward speed.

The patentable embodiments of this invention that are claimed are as follows:

1. A system for lifting and supporting a string of downwardly extending pipe from a surface vessel, the system comprising a platform, pivotally connected to a surface vessel about two horizontal, transverse axes of rotation, the platform having a central opening therethrough;

a hoist carriage, reciprocally, vertically, movably supported by the platform and having a central opening therethrough, in line with the central opening of the platform;

first pipestring support means and second pipestring support means secured to the platform and hoist carriage respectively, and so arranged thereon that the first and second support means are in close-coupled relationship when the hoist carriage is in a position immediately adjacent the platform;

the first and second pipestring support means each comprising: a plurality of hydraulically activated, reciprocally, radially movable support plates spaced about the central openings; mechanical stop means for predetermining the distance each support plate can move radially inwardly to a supporting position, enabling presetting of the support plates for pipe of varying outer diameters; and mechanical locking means for mechanically locking the support plates into its radially inwardmost, preset, supporting position;

whereby a pipestring is vertically moved between the surface vessel and the ocean floor by being alternately engaged and supported by the first and second support means, on complementary sets of close-coupled surfaces on the segments of the pipestring.

2. The system of claim 1, wherein the first support means comprise reciprocally, radially movable elements having a generally upwardly facing surface and capable of moving radially away from and extending at least partially across the central opening through the platform; and the second support means comprise radially reciprocally movable elements supported on the carriage capable of moving away from and at least partially across the central opening therethrough, and having a generally upwardly facing support surface.

3. The system of claim 2, wherein the support elements are hydraulically actuated support plates.

4. The system of claim 3, wherein the support means comprise a plurality of support plates spaced about the central opening and comprising in addition mechanical stop means for predetermining the distance each element moves radially inwardly across the central opening to reach a supporting position;

whereby the elements can be preset to support pipe segments of varying outer diameters.

5. The system of claim 1 wherein the hoist carriage moves vertically beneath the platform a distance at least equal to the distance between adjacent sets of close-coupled support surfaces on the pipestring.

6. The system of claim 5 wherein the first support means are secured to the lower surface of the platform and the second support means are secured to the upper surface of the carriage.

7. A system for lifting and supporting a string of downwardly extending pipe from a surface vessel, the system comprising a platform, pivotally connected to a surface vessel about two horizontal, transverse axes of rotation, the platform having a central opening therethrough;

a hoist carriage, reciprocally, vertically, movably supported by the platform and having a central opening therethrough, in line with the central opening of the platform;

first pipestring support means and second pipestring support means secured to the platform and hoist carriage respectively, and so arranged thereon that the first and second support means are in close-coupled relationship when the hoist carriage is in a position immediately adjacent the platform;

levelling means to maintain the carriage horizontally level relative to the platform as the carriage moves vertically relative to the platform, the levelling means comprising a pair of longitudinally extended toothed members, having teeth substantially regularly spaced therealong and extending along and adjacent the moving hoist carriage and a meshing rotating tooth member, having complementarily spaced teeth, rotatably secured to the hoist carriage, the two pairs of toothed members meshing together as the hoist carriage moves vertically;

whereby a pipestring is vertically moved between the surface vessel and the ocean floor by being alternately engaged and supported by the first and second support means, on complementary sets of close-coupled surfaces on the segments of the pipestring.

* * * * *